US010567882B2

(12) United States Patent
Guo et al.

(10) Patent No.: US 10,567,882 B2
(45) Date of Patent: Feb. 18, 2020

(54) LOUDSPEAKER STRUCTURE

(71) Applicant: Tymphany Acoustic Technology (Huizhou) Co., Ltd., Huizhou (CN)

(72) Inventors: Changlin Guo, Taipei (TW); Richeng Yao, Taipei (TW)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 15/662,537

(22) Filed: Jul. 28, 2017

(65) Prior Publication Data

US 2018/0063643 A1 Mar. 1, 2018

(30) Foreign Application Priority Data

Aug. 26, 2016 (CN) ..... 2016 1 731925

(51) Int. Cl.

| | |
|---|---|
| ***H04R 25/00*** | (2006.01) |
| ***H04R 9/06*** | (2006.01) |
| ***H04R 9/04*** | (2006.01) |
| ***H04R 1/02*** | (2006.01) |
| ***H04R 1/24*** | (2006.01) |
| ***H04R 7/16*** | (2006.01) |
| ***H04R 9/02*** | (2006.01) |
| *H04R 7/12* | (2006.01) |
| *H04R 1/22* | (2006.01) |

(52) U.S. Cl.

CPC ..... *H04R 9/06* (2013.01); *H04R 1/025* (2013.01); *H04R 1/24* (2013.01); *H04R 7/16* (2013.01); *H04R 9/025* (2013.01); *H04R 9/045* (2013.01); *H04R 1/22* (2013.01); *H04R 7/127* (2013.01); *H04R 2209/022* (2013.01); *H04R 2307/021* (2013.01)

(58) Field of Classification Search

CPC . H04R 9/06; H04R 7/18; H04R 9/025; H04R 2400/03; H04R 2499/11

See application file for complete search history.

(56) References Cited

U.S. PATENT DOCUMENTS

| | | | | |
|---|---|---|---|---|
| 2,137,780 A * | 11/1938 | Paredes | ..... | H04R 9/025 381/418 |
| 4,783,824 A * | 11/1988 | Kobayashi | ..... | H04R 9/025 381/402 |
| 2002/0071588 A1* | 6/2002 | Proni | ..... | H04R 9/045 381/403 |
| 2004/0042631 A1* | 3/2004 | Amino | ..... | H04R 9/025 381/412 |

* cited by examiner

*Primary Examiner* — Amir H Etesam

(74) *Attorney, Agent, or Firm* — Muncy, Geissler, Olds & Lowe, P.C.

(57) ABSTRACT

A loudspeaker includes a magnet, a T-yoke, a frame, a top plate, a voice coil, a damper, a dust cap, a cone paper, and a gasket. The cone paper being provided with a surround, the gasket being located below the outer edge of the frame, the magnet being located above said T-yoke. A magnetic gap is formed between the top plate and the T-yoke. The voice coil being arranged in the magnetic gap, the voice coil including VC wire part and VC tube part. The top plate being provided with a riveted groove on the outer side, the top plate being riveting mounted in the frame via the riveted groove.

10 Claims, 3 Drawing Sheets

LOUDSPEAKER STRUCTURE

CROSS REFERENCE TO RELATED APPLICATION

This application is related to and claims the benefit of Chinese Patent Application Number 20161731925 filed on Aug. 26, 2016, the contents of which are herein incorporated by reference in their entirety.

BACKGROUND

The invention generally relates to technology field of loudspeaker manufacturing, and especially relates to a loudspeaker structure.

The loudspeaker is an acoustic component used to complete the conversion between electrical signals and sound signals, and has been widely used in in electronic terminals such as televisions and sound systems.

With the rapid development of portable WIFI speaker, Bluetooth speaker and ultra-thin TV and other products, the loudspeaker tends to be ultra-thin structure designed and optimized.

A loudspeaker is desired, which has characteristics, like a small diameter, high power, high sensitivity, a strong structure and smooth acoustic response curve.

SUMMARY

A loudspeaker includes a magnet, a T-yoke, a frame, a top plate, a voice coil, a damper, a dust cap, a cone paper, and a gasket. The cone paper being provided with a surround, the gasket being located below the outer edge of the frame, the magnet being located above said T-yoke. A magnetic gap is formed between the top plate and the T-yoke. The voice coil being arranged in the magnetic gap, the voice coil including VC wire part and VC tube part. The top plate being provided with a riveted groove on the outer side, the top plate being riveting mounted in the frame via the riveted groove.

DETAILED DESCRIPTION

Figure 1:
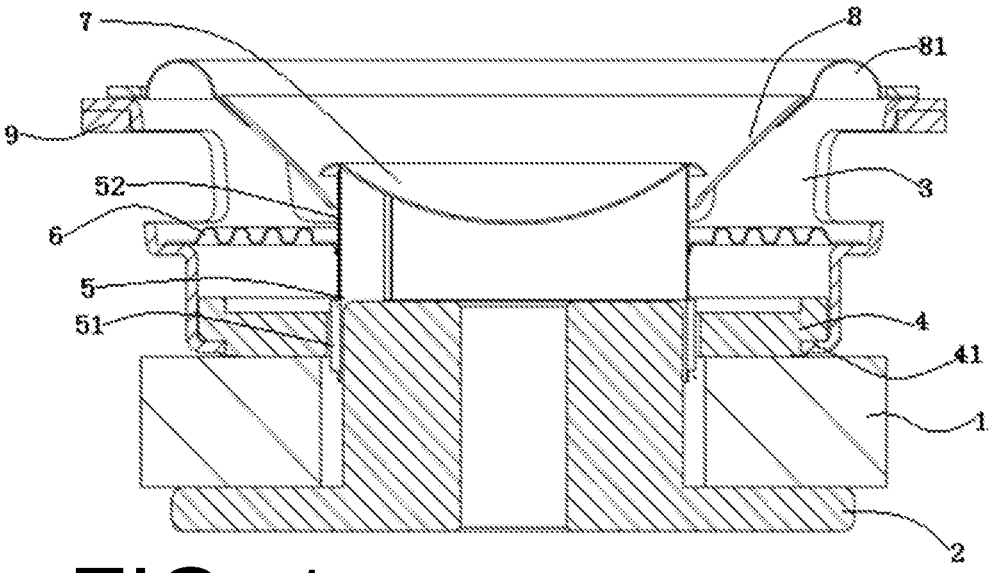
FIG. 1 is a sectional drawing of an exemplary embodiment of a loudspeaker structure.

In mounting a top plate and frame of loudspeaker, there are two traditional methods, method one: stamping the top plate to form bulges, then riveting with the frame hole. However, the top plate used in a loudspeaker with a small diameter is usually relatively thin, so that the height of the riveting point would be relatively short and the riveting deformation is not enough to rivet tightly. As the top plate is not riveted with frame tightly, the frame may easy separate from the top plate causing riveting structural failure and other issues.

Method 2: the top plate is connected to the frame by screw or fastener. As the screw hole of the top plate is too small, the punch needle may easily break during the processing of the bottom hole punch through. In addition, the damper will hit the screw head and produce abnormal sound when loudspeaker is working as the screw head occupies more space when installed.

Therefore, there is a desirable for a fixed structure applied to the top plate and the frame in a small-caliber loudspeaker such that the structure does not interfere with the damper and the voice coil.

In order to fully comprehend the features and efficacy of the present embodiments, the embodiments will now be described more fully hereinafter with reference to the accompanying drawings, in which various exemplary embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected with", "connected to" or "coupled to" another element or layer, it can be directly on, connected or coupled to the other element or layer or intervening elements or layers may be present.

Unless defined otherwise, all technical and scientific terms used herein have the same meaning as those commonly understood by one of ordinary skill in the art. All publications and patents referred to herein are incorporated by reference herein in their entireties.

Figure 2:
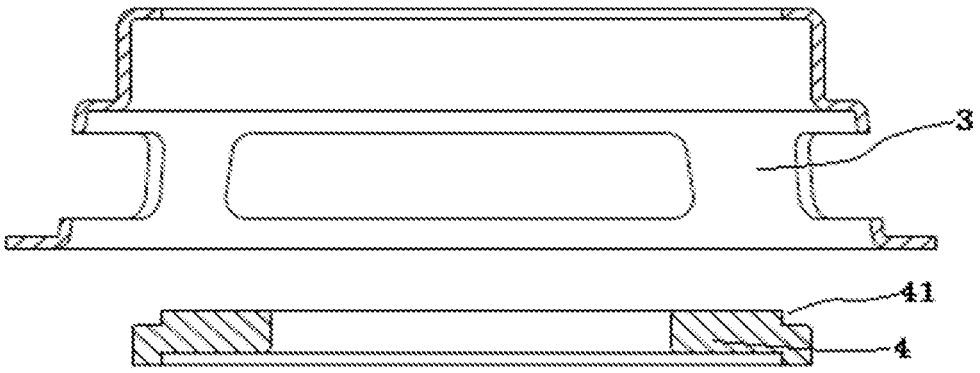
FIG. 2 is a sectional drawing of the top plate and the frame of the loudspeaker structure.
Figure 3:
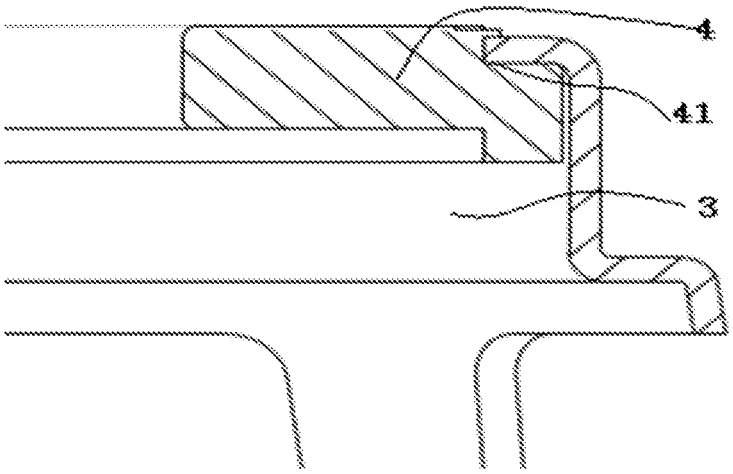
FIG. 3 is a close up view of the top plate and the frame of the loudspeaker structure.
Figure 4:
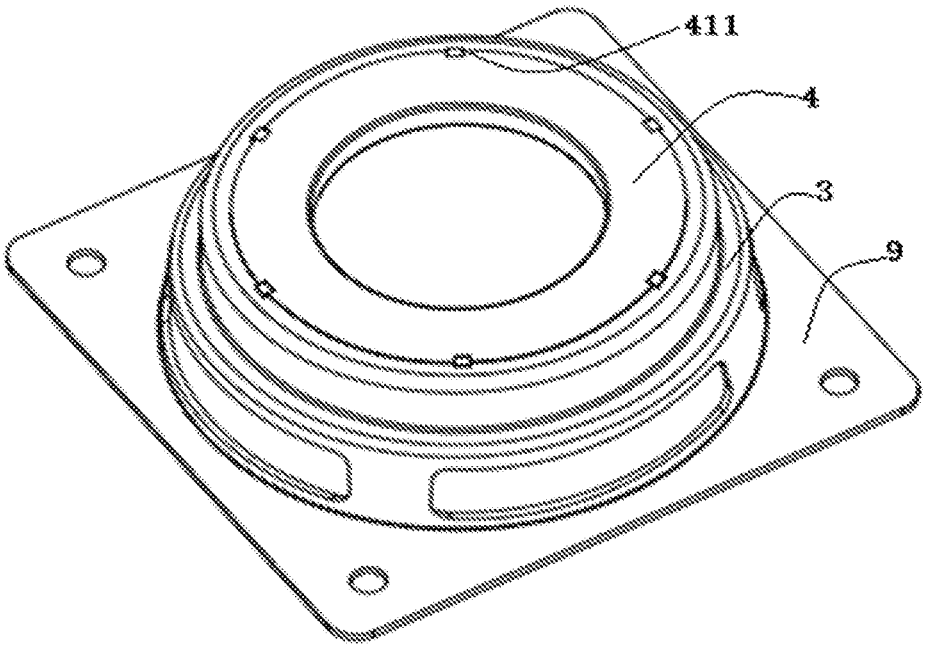
FIG. 4 is a perspective view of the loudspeaker structure.

FIG. 1 is a side cross-sectional drawing of a loudspeaker structure in accordance with an embodiment; FIG. 2 is a side cross sectional drawing of the top plate and the frame in accordance with an embodiment; FIG. 3 is a portion of a side cut-away view of the top plate and the frame; FIG. 4 is perspective view of an assembled loudspeaker structure.

Referring to FIG. 1 to FIG. 4, an exemplary loudspeaker structure comprises a magnet 1, a T-yoke 2, a frame 3, a top plate 4, a voice coil 5, a damper 6, a dust cap 7, a cone paper 8 and a gasket 9. The cone paper 8 is provided with a surround 81. The gasket 9 is located below the outer edge of the frame 3, and the magnet 1 is located above the T-yoke 2. A magnetic gap is formed between the top plate 4 and the T-yoke 2, and the voice coil 5 is setup in the magnetic gap. The voice coil 5 includes VC wire part 51 and VC tube part 52; One end of the damper 6 is connected with the voice coil 5; the other end of the damper 6 is connected with the frame 3.

The top plate 4 is provided with a riveted groove 41 on the outer side, and then the top plate 4 is rivet mounted in the frame 3 via the riveted groove 41.

In the loudspeaker structure of the illustrated exemplary embodiment, the riveting groove 41 is deformed outwardly to form six riveting points after the outer side of the top plate 4 is punched by the die. Then the top plate 4 is rivet mounted with the frame 3 using rivets 411. Compared with screw fixation of the top plate and the frame, this kind riveting of the top plate 4 and the frame 3, reduces the overall height of the loudspeaker to ensure the vibration range of the damper 6. (E.g., by not using screws that may interfere with the damper 6 by contacting the damper 6.)

In this embodiment, the top plate 4 is provided with a riveted groove 41. The structure of riveted groove 41 is an annular structure.

Figure 5:
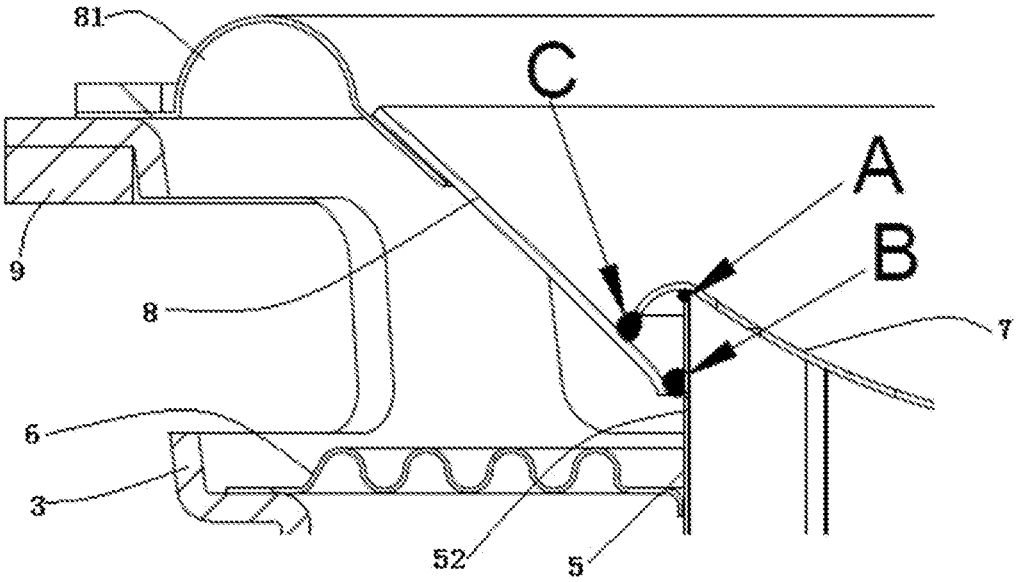
FIG. 5 is a portion of a side cut-away view of gluing connections of a loudspeaker structure.
Figure 6:
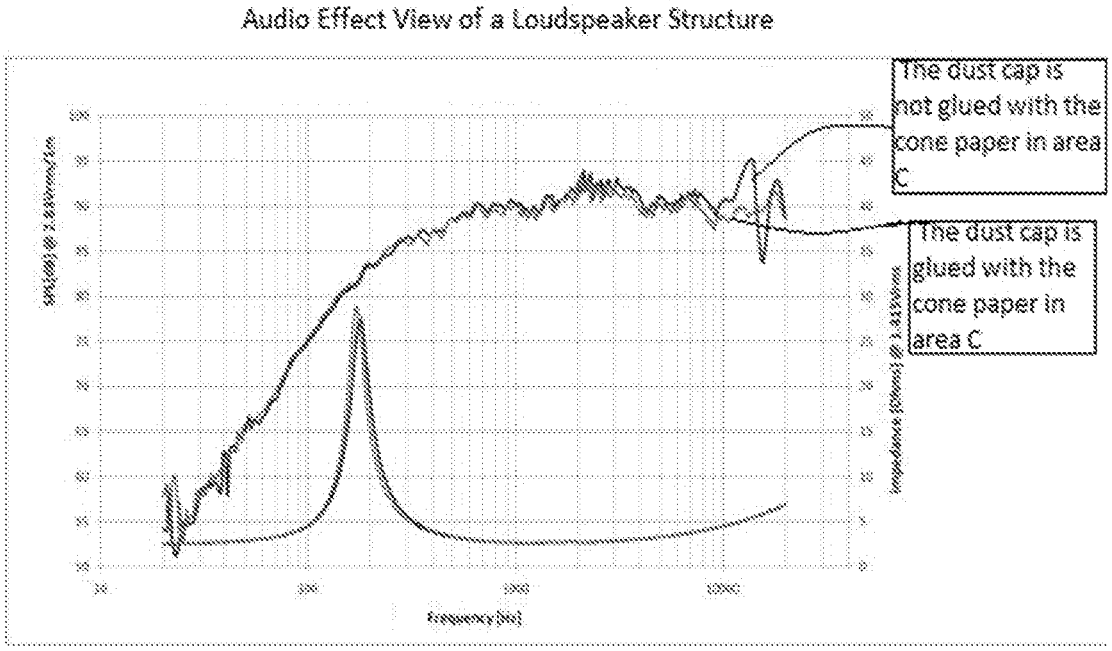
FIG. 6 is graph illustrating the audio effect of an exemplary loudspeaker structure.

FIG. 5 is a portion of a side cut-away view illustrating the gluing connection of an exemplary embodiment of a loudspeaker structure. FIG. 6 is a graph showing the audio effect view of a loudspeaker structure in accordance with the illustrated embodiments.

In previous loudspeakers the voice coil is glued to the dust cap and the cone paper via the VC tube part respectively during the manufacturing process of the loudspeaker.

As shown in FIG. 5, in the illustrated embodiment of a loudspeaker structure, the VC tube part 52 is glued with the dust cap 7 in area A and the VC tube part 52 is glued with the cone paper 8 in area B, the dust cap 7 is connected with the cone paper 8 in area C by glue.

In particular, as shown in FIG. 6, the response curve is smoother in the high frequency of the acoustic frequency, especially in the frequency range of 8000~20 KHz after the dust cap 7 is connected with the cone paper 8 by glue. It can eliminate the poor sensation caused by the curve peak and valley fluctuations and get a nice experience when listening to music.

The present invention is disclosed by the preferred embodiment in the aforementioned description; however, it is contemplated for one skilled at the art that the embodiments are applied only for an illustration of the present invention rather than are interpreted as a limitation for the scope of the present invention. It should be noted that the various substantial alternation or replacement equivalent to these embodiments shall be considered as being covered within the scope of the present invention. Therefore, the protection scope of the present invention shall be defined by the claims.

What is claimed is:

1. A loudspeaker comprising:

a magnet;

a T-yoke;

a frame;

a top plate;

a voice coil;

a damper;

a dust cap;

a cone paper; and a gasket, wherein said cone paper is provided with a surround, wherein said gasket is located below an outer edge of said frame, wherein said magnet is located above said T-yoke, a magnetic gap being formed between said top plate and said T-yoke, wherein said voice coil is arranged in said magnetic gap, wherein said voice coil includes a VC wire part and a VC tube part, wherein said top plate is provided with an annular riveted groove formed along an outer periphery of the top plate, and wherein said top plate is riveting mounted in said frame via the riveted groove.

2. The loudspeaker as claimed in claim 1, wherein said voice coil is glued with said dust cap and said cone paper via the VC tube part respectively, and wherein said dust cap is connected with said cone paper by glue.

3. The loudspeaker as claimed in claim 1, wherein said top plate is rivet mounted in said frame, at stamp formed riveting points, and wherein the number of said riveting points is five or six.

4. The loudspeaker as claimed in claim 1, wherein one end of said damper is connected with the voice coil, and wherein an other end of said damper is connected with the frame.

5. The loudspeaker as claimed in claim 1, wherein the riveted groove is delimited at an underside of the top plate.

6. The loudspeaker as claimed in claim 5, wherein the frame extends radially outward of the periphery of the top plate and to the underside of the top plate.

7. The loudspeaker as claimed in claim 6, wherein the frame comprises a flange which extends radially inward, and wherein the riveted groove is configured to receive the flange.

8. The loudspeaker as claimed in claim 1, wherein the riveted groove is deformed outwardly to faun a plurality of riveting points.

9. The loudspeaker as claimed in claim 1, wherein the riveted groove comprises a plurality of outwardly disposed riveting points.

10. The loudspeaker as claimed in claim 1, wherein the riveted groove comprises six outwardly disposed riveting points.

* * * * *